US007543441B2

(12) United States Patent
Cagan et al.

(10) Patent No.: US 7,543,441 B2
(45) Date of Patent: Jun. 9, 2009

(54) HALL-EFFECT PLASMA THRUSTER

(75) Inventors: Vladimir Cagan, Bagnolet (FR); Patrice Renaudin, Boutigny sur Opton (FR); Marcel Guyot, Droue/Drouette (FR)

(73) Assignee: Centre National d'Etudes Spatiales, Paris (FR)

( * ) Notice: Subject to any disclaimer, the term of this patent is extended or adjusted under 35 U.S.C. 154(b) by 401 days.

(21) Appl. No.: 10/519,679

(22) PCT Filed: Jul. 7, 2003

(86) PCT No.: PCT/FR03/02100

§ 371 (c)(1),
(2), (4) Date: Aug. 18, 2005

(87) PCT Pub. No.: WO2004/007957

PCT Pub. Date: Jan. 22, 2004

(65) Prior Publication Data

US 2006/0010851 A1 Jan. 19, 2006

(30) Foreign Application Priority Data

Jul. 9, 2002 (FR) ..... 02 08612

(51) Int. Cl.
*F03H 1/00* (2006.01)

(52) U.S. Cl. ..... 60/202; 60/203.1; 313/262.1

(58) Field of Classification Search ..... 60/202, 60/203.1; 313/359.1, 362.1; 315/111.21, 315/111.41

See application file for complete search history.

(56) References Cited

U.S. PATENT DOCUMENTS 5,218,271 A * 6/1993 Egorov et al. ..... 315/111.61
5,359,258 A 10/1994 Arkhipov et al.
5,646,476 A * 7/1997 Aston ..... 313/359.1
5,763,989 A 6/1998 Kaufman
5,838,120 A 11/1998 Semenkin et al.
5,847,493 A * 12/1998 Yashnov et al. ..... 313/231.31
5,945,781 A * 8/1999 Valentian ..... 315/111.81
6,281,622 B1 8/2001 Valentian et al.

* cited by examiner

*Primary Examiner*—Louis J Casaregola
(74) *Attorney, Agent, or Firm*—Oblon, Spivak, McClelland, Maier & Neustadt, P.C.

(57) ABSTRACT

A plasma thruster having a magnetic circuit of a downstream bottom plate from which arms protrude. At least one of the arms includes a permanent magnet. The mass, overall dimensions, electricity consumption, and cost of the thruster are thereby reduced.

6 Claims, 4 Drawing Sheets

HALL-EFFECT PLASMA THRUSTER

TECHNICAL FIELD

This invention relates to the field of plasma thrusters, particularly Hall-effect plasma thrusters.

Such engines, for example, may be used in space, e.g., in order to keep a satellite in geostationary orbit, or to transfer a satellite from one orbit to another, or to compensate for drag forces exerted on satellites in low orbit, or else for missions requiring low thrusts over long periods of time such as during an interplanetary mission.

Prior Art

Such thrusters are known and have already been the subject of disclosures, e.g., in the U.S. Pat. No. 6,281,622, or else in the U.S. Pat. No. 5,359,258.

The detailed structure of such thrusters is described in these two documents. It will be used hereinafter in connection with FIGS. 1 and 2, a simplified schematic of such a structure. This schematic is specifically intended to provide explanations concerning the operation of such a thruster.

FIG. 1 shows an axial section of one example of such a thruster, and FIG. 2 shows a perspective view as seen from the rear of said thruster example.

The thruster is substantially a revolution shape around an axis OO'. The cutting plane of FIG. 1 comprises this axis OO'. A backward-forward or downstream-upstream direction in the axial direction is indicated by arrows E showing substantially the direction of an electric field created by the association of an annular anode 1 placed behind an annular channel 3 and a cathode 2 placed substantially in front of the annular channel 3, to the outside thereof and adjacent thereto. The arrangement of the cathode 2 thus makes it possible to create an electric field with the anode I that is oriented substantially in the axial direction OO', while at the same time being outside of the propulsive flow. For purposes of reliability, as shown in FIG. 2, this cathode is generally duplicated by a second fail-safe cathode. The annular anode 1 has an annular bottom placed concentrically in relation to the annular channel 3. This bottom comprises passages, e.g., in the form of through-holes allowing the passage of a gas which can be ionized, e.g., xenon.

The thruster comprises a magnetic circuit 40 made of magnetic ferrous materials consisting of a plate 4 perpendicular to the axis OO' of the thruster, a central arm 41 having for its axis the axis OO', two circular cylindrical poles 63 and 64 having for their axis the axis OO' and exterior peripheral arms 42, arranged in rotational symmetry around the axis OO', on the exterior of the annular channel 3. The peripheral arms 42 may number 2, 3, 4 or more, or else consist of a single annular arm. The central arm 41 is terminated at Its upstream end by a central magnetic pole 49, and each of the exterior peripheral arms 42 is terminated at its upstream end by a magnetic pole 48. The magnetic poles 48 consist of plates that are substantially perpendicular to the axial direction OO'. As described in the previously cited U.S. Pat. No. 6,281,622, column 5, lines 51-62, they may be angled, for example, between −15 and +15 degrees in relation to a plane perpendicular to the axis OO'. A central coil 51 centered on the central arm 41, and peripheral coils 52 wound around the exterior magnetic arms 42 make it possible to create magnetic field lines joining the central pole 49 to the peripheral poles 48 and the pole 63 to the pole 64. The magnetic field inside the annular channel is thus substantially perpendicular to the axis OO'. This direction of the magnetic field inside the annular channel 3 is indicated by arrows M in FIG. 1. Of course, as is known, the magnetic field lines inside the annular channel are not all parallel to one another. The annular channel 3 is physically formed by internal and external annular walls 61, 62, respectively, both centered on the axis OO'. These walls consist of a refractory material that is as resistant to ablation as possible.

The theoretical operating model of such a device has not yet been perfectly mastered. However, it is agreed that the operation can substantially be explained as follows. Electrons emitted by the cathode 2 travel towards the anode 1 from the upstream portion towards the downstream portion of the annular channel 3. A portion of these electrons is trapped in the annular channel 3 by the magnetic field between poles. The collisions between electrons and gas molecules help to ionize the gas introduced into the channel 3 through the anode 1. The mixture of ions and electrons then forms a self-sustained ionized plasma. The ions are ejected downstream aided by the electric field, thereby creating an engine thrust directed upstream. The jet is electrically neutralized by electrons coming from the cathode 2.

The exhaust velocity of the ions is approximately 5 times greater than the exhaust velocity that can be obtained with chemical thrusters. It follows that, with a much smaller ejected mass, it is possible to obtain improved thrust efficiency.

The power supply to the coils creating the magnetic field requires an electrical power supply consisting, in general, of solar panels.

DISCLOSURE OF THE INVENTION

In relation to the prior art just described, the invention aims at a plasma thruster which, for the same thrust, has a reduced consumption of electrical current and therefore a reduced mass of electrical generators, and a reduced mass and overall dimensions for the magnetic circuit, increased reliability and finally a lower production cost.

According to the invention, the coils creating a magnetic field have a smaller number of wound coils made of a special high-temperature wire. This smaller number of wound coils produces the following advantages. Losses due to the Joule effect are reduced, which results in reduced thruster heating; the reliability of the thruster is increased because the special high-temperature wire is fragile. The total mass of the magnetic field-producing elements is reduced, due to reduction in the number of coils and corresponding overall dimensions of the magnetic circuit. The production cost is reduced because the special high-temperature wire is expensive, and because the coils are simplified, whose role is then limited to a simple adjustment in the value of the magnetic field. Last, the thruster is likewise made lighter by the reduced mass of the electric power supplies, made possible by the reduction in current consumption.

For all these purposes, the invention relates to a Hall-effect plasma thruster having a longitudinal axis substantially parallel to a thrust direction defining an upstream portion and a downstream portion, and comprising:

- a primary ionization and acceleration channel made of a refractory material, the annular channel being open at its upstream end,
- an annular gas-dispensing anode receiving gas from gas-distribution lines and equipped with passages for admitting this gas into the annular channel, said annular anode being placed inside of the channel in an upstream portion of said channel,
- at least one hollow cathode arranged outside the annular channel, adjacent thereto, a magnetic circuit comprising upstream polar ends for creating a radial magnetic field in an upstream portion of the annular channel between these polar parts, said circuit consisting of a downstream plate, from which protrude, upstream and parallel to the axis, a central arm situated at the center of the annular channel, two circular cylindrical poles on both sides of the annular channel, and peripheral arms situated on the exterior of the annular channel and adjacent thereto, the plasma thruster, is characterized in that at least one of the arms of the magnetic circuit comprises a permanent magnet.

In one embodiment, a portion of the arms of the magnetic circuit comprises a permanent magnet and another portion of the arms of the magnetic circuit does not comprise permanent magnets.

In another embodiment, all of the arms of the magnetic circuit comprise a permanent magnet.

When the magnetic circuit comprises a field coil, the latter is wound around an arm not comprising an permanent magnet.

No field coil is engaged around the arms of the magnetic circuit 40 comprising a permanent magnet.

BRIEF DESCRIPTION OF THE DRAWINGS

Embodiments of the invention will now be described for non-limiting, illustrative purposes, in conjunction with the appended drawings.

DETAILED DISCLOSURE OF PARTICULAR EMBODIMENTS

In the embodiments that will be described below, only the magnetic circuit of a thruster according to the invention is described. These circuits provide the same functions as known magnetic circuits and are arranged in a similar fashion.

These circuits differ from the prior art by the fact that one or more arms of the circuit comprise permanent magnets, e.g., rare earth magnets. This characteristic makes it possible to reduce the number of coils of the field coils, possibly to the point of eliminating these coils or a portion of these coils. The reduction in the overall dimensions of the coils, which results from this modification, makes it possible to reduce the cross-dimension of the magnetic circuit, since the thickness of the coils to be housed can be reduced. Said reduction likewise makes it possible to reduce the axial dimension, which is often determined on the basis of the number of coils to be engaged around the central arm. It thereby becomes possible to limit the axial length of the thruster to the minimum length of the ionization chamber.

Figure 1:
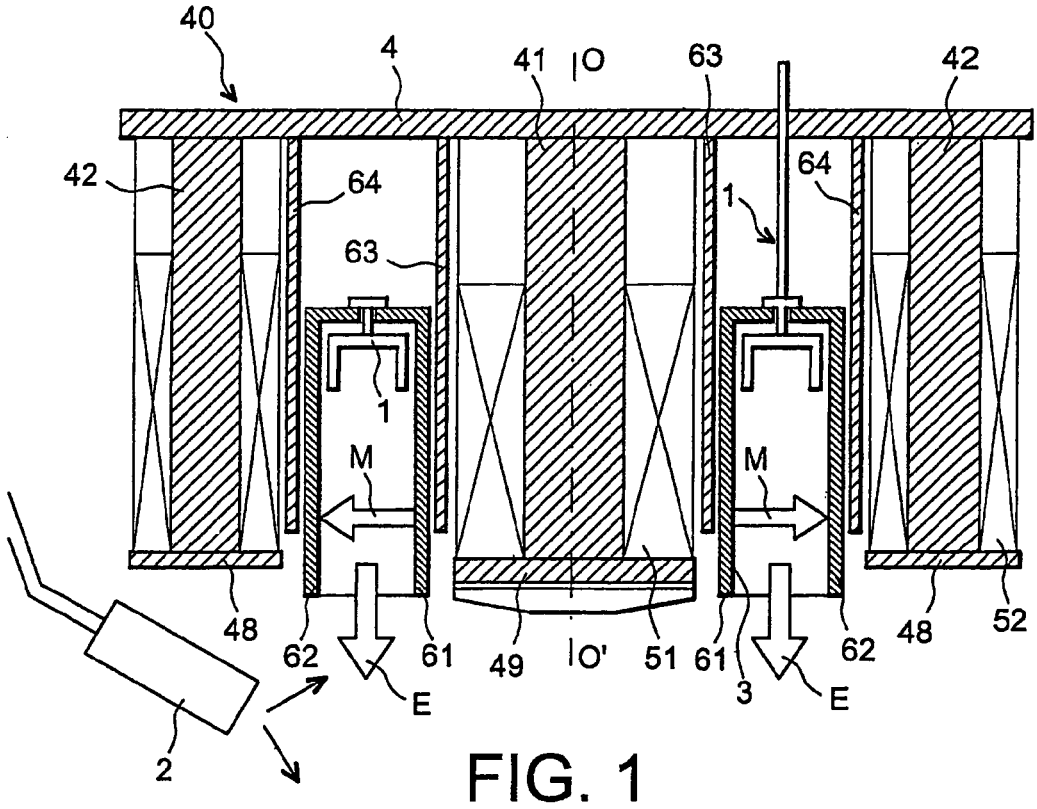
FIGS. 1 and 2, that have already been commented upon, show, respectively, an axial section, and a perspective view seen from behind of one sample embodiment of a plasma thruster according to the prior art.
Figure 2:
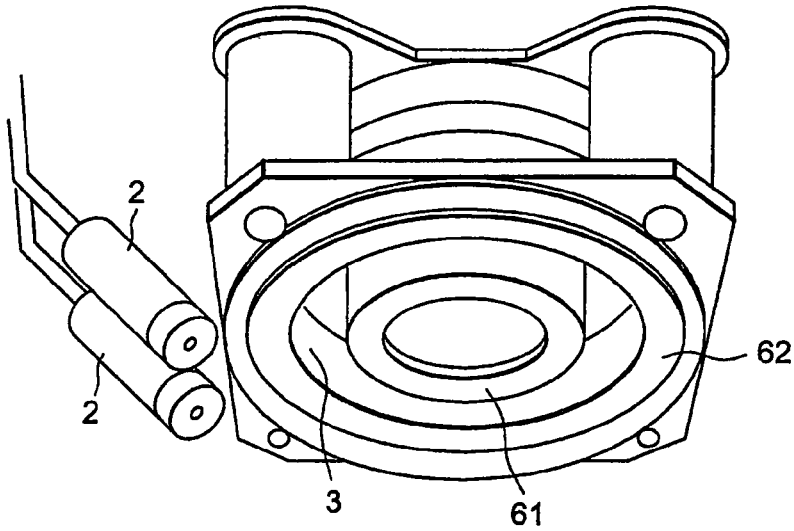
Figure 3A:
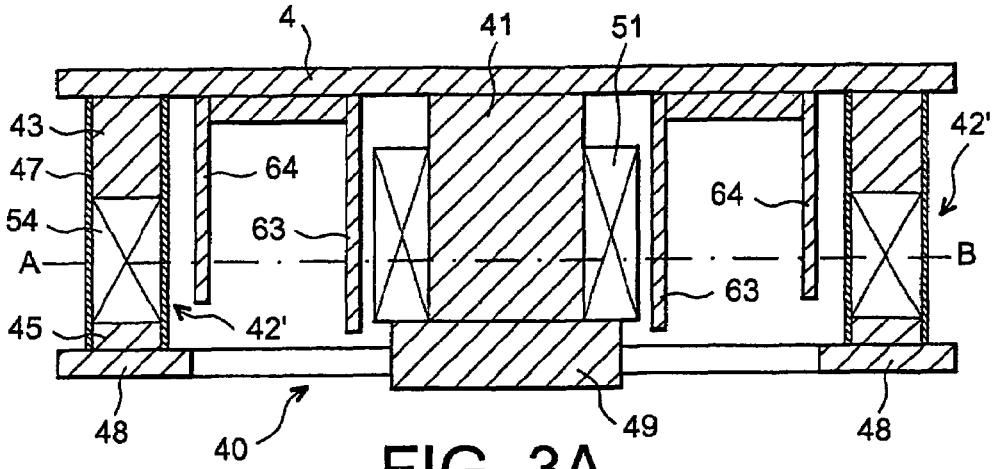
FIG. 3A shows an axial section of a first sample magnetic circuit of a plasma thruster according to the invention, the section having been made along the line CD of FIG. 3B.

As in the prior art described in connection with FIGS. 1 and 2, each of the magnet circuit 40 embodiments described in connection with FIGS. 3, 4 and 5A and B comprise a downstream plate 4, made of a soft magnetic material, placed perpendicularly to an axis OO'of the circuit 40. This plate is completed by a cylindrically shaped central arm 41, having the axis OO'for its axis, by circular cylindrical poles 63 and 64, having the axis OO'for their axis and arranged on both sides of an annular channel 3, and by peripheral arms 42, 43 arranged in rotational symmetry around the axis OO',on the exterior of the annular channel 3. In FIGS. 3A and B and 4A and B, there are four peripheral arms 42. Of course, the number of arms may differ. In particular, it may be greater than 4, as shown in FIGS. 5A and B, where this number is 8, due to the reduction in overall dimensions resulting from the cutback or reduction in the size of the field coils.

Each of the arms 41, 42 is terminated in its upstream portion by a magnetic pole, referenced as 49, for the pole of the central arm 41, and as 48 for each of the poles of the peripheral arms 42. Each pole 49, 48 terminating an arm 41, 42, respectively, is arranged perpendicularly to the axis of said arm. The angle of inclination of the poles may be different, as described in connection with the description of the prior art.

The increase in the number of separate peripheral arms brings about an improvement in the circular symmetry of the magnetic field, between the central pole 49 and the peripheral poles 48.

Contrary to the prior art described, at least one of the arms comprises a permanent magnet forming a portion of the axial length of the arm. The arms comprising a permanent magnet bear the reference number 41', when the central arm is involved, and 42' when the peripheral arm is involved. In FIGS. 3, 4, 5 A and B, the permanent magnet is referenced as 54, when it is built into the central arm 41'.

Figure 3B:
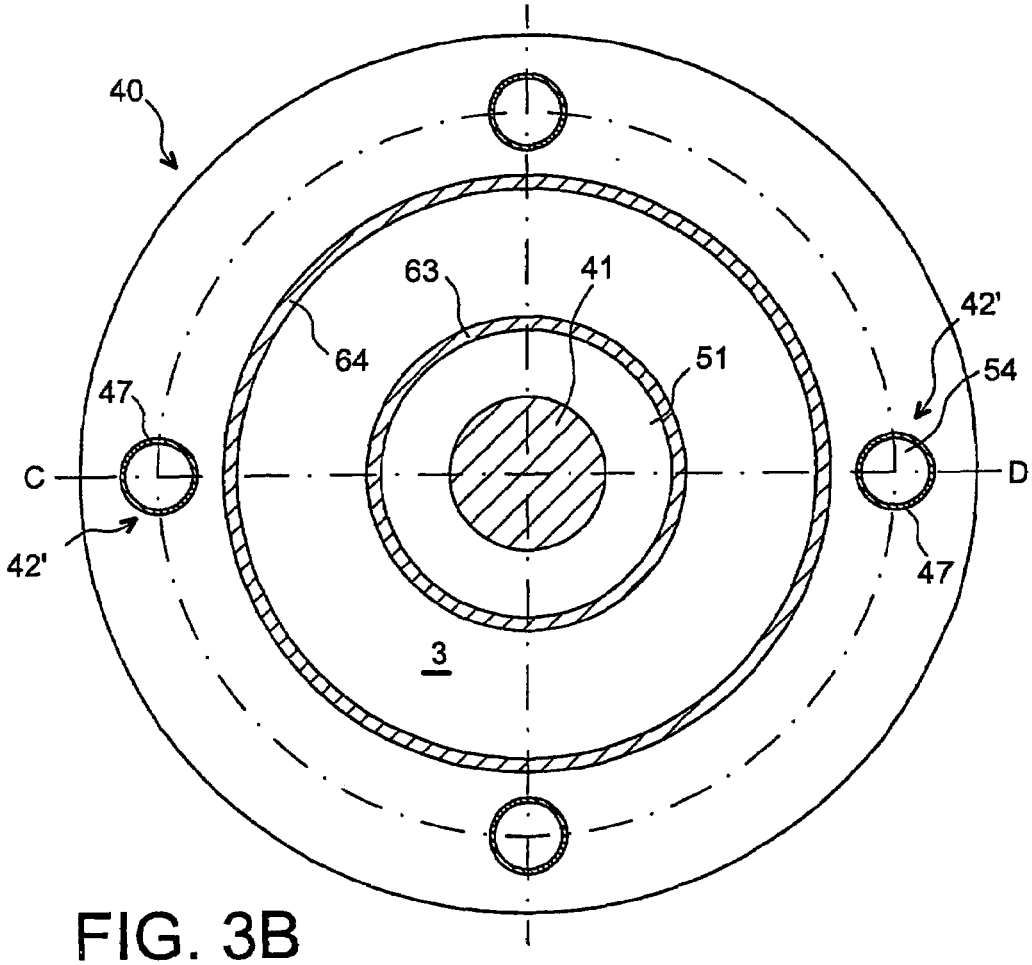
FIG. 3B shows a cross-section of a first example magnetic circuit of a plasma thruster according to the invention, the section having been made along the line AB of FIG. 3A.

In the example shown in FIGS. 3 A and B, all of the peripheral arms 42' are thus formed from the downstream portion to the upstream portion of a downstream portion 43 made of a soft magnetic material in contact with the downstream plate 4, from a rare earth magnet 54, an upstream portion 45 made of a soft magnetic material, this upstream portion 45 holding the magnetic pole 48. It is seen that a central portion of the arm adjacent to the downstream portion 43 and to the upstream portion 45 consists of said permanent magnet 54.

In the example shown in FIGS. 3 A and B, the central arm 41 is made entirely of a soft magnetic material. A central coil 51 made, as in the prior art, of a special high-temperature wire, comprising a metal sheath around a central conductor, makes it possible to adjust the magnetic field between poles. In this configuration, no peripheral field coil is arranged around the peripheral arms 42'.

Thus, in this first sample embodiment, the peripheral arms 42' each comprise a permanent magnet 54, and the central arm 41 is made of a magnetic material only, a field coil 51 being engaged around said central arm 41.

Figure 4A:
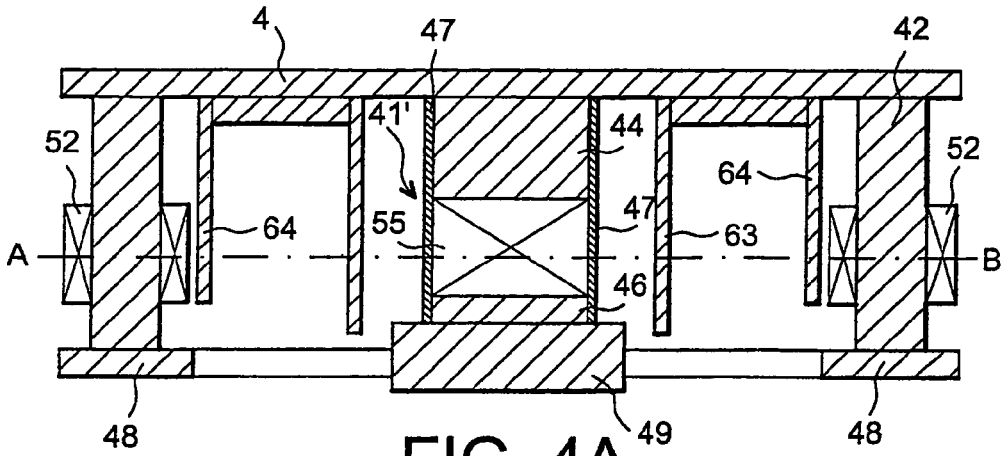
FIG. 4A shows an axial section of a second example magnetic circuit of a plasma thruster according to the invention, the section having been made along the line CD of FIG. 4B.
Figure 4B:
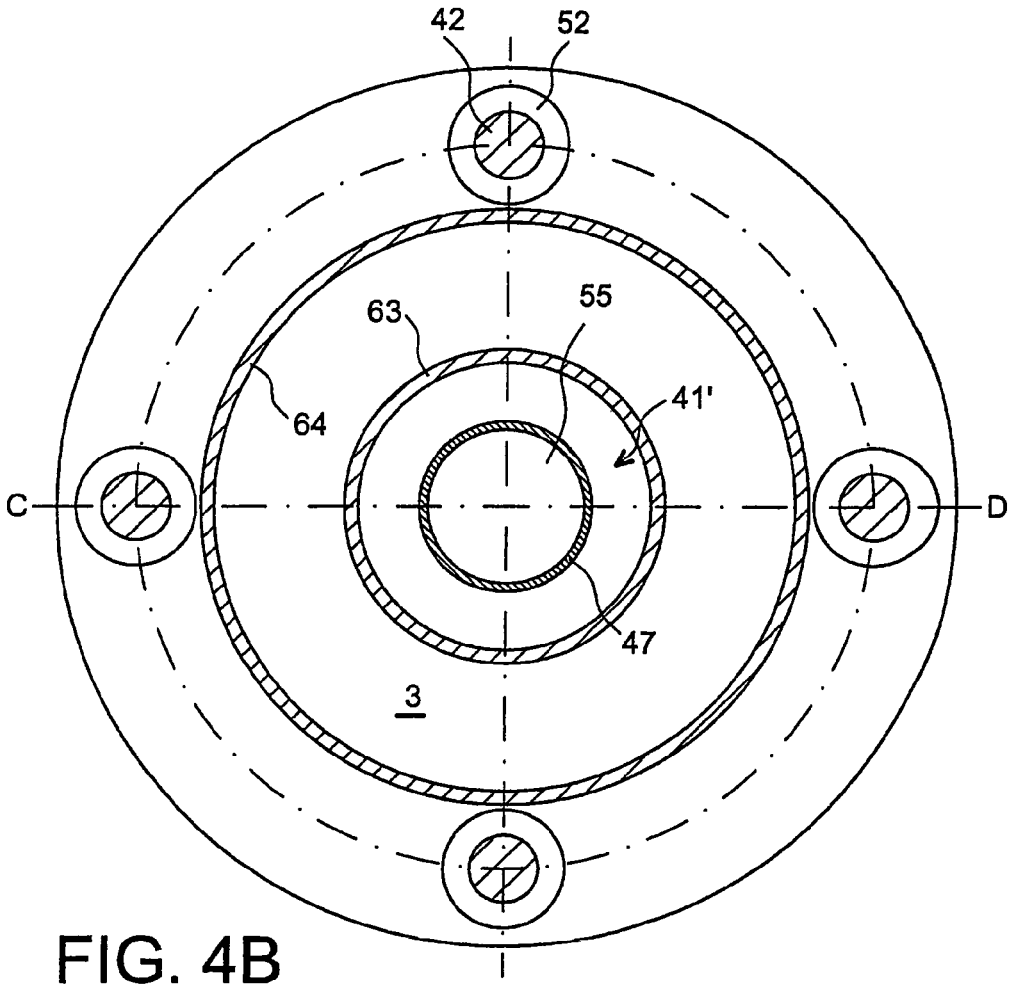
FIG. 4B shows a cross-section of the second example magnetic circuit of a plasma thruster according to the invention, the section having been made along the line AB of FIG. 4A.
Figure 5A:
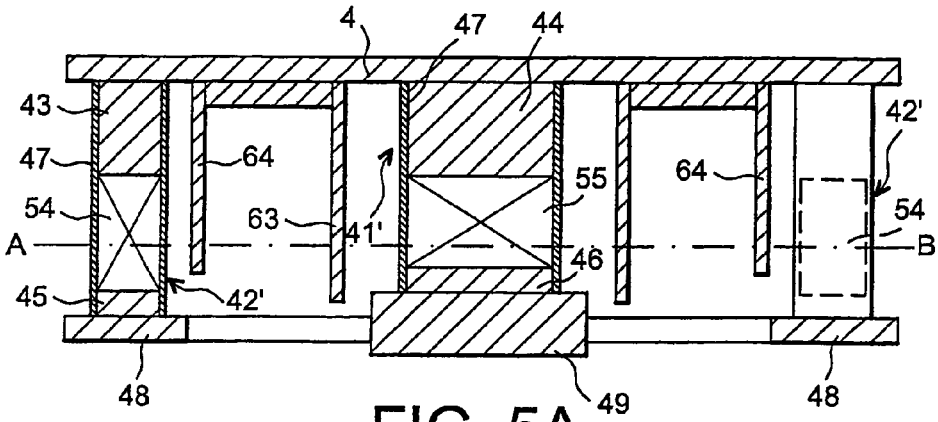
FIG. 5A shows an axial section of a third example magnetic circuit of a plasma thruster according to the invention, the section having been made along the line CD of FIG. 5B.
Figure 5B:
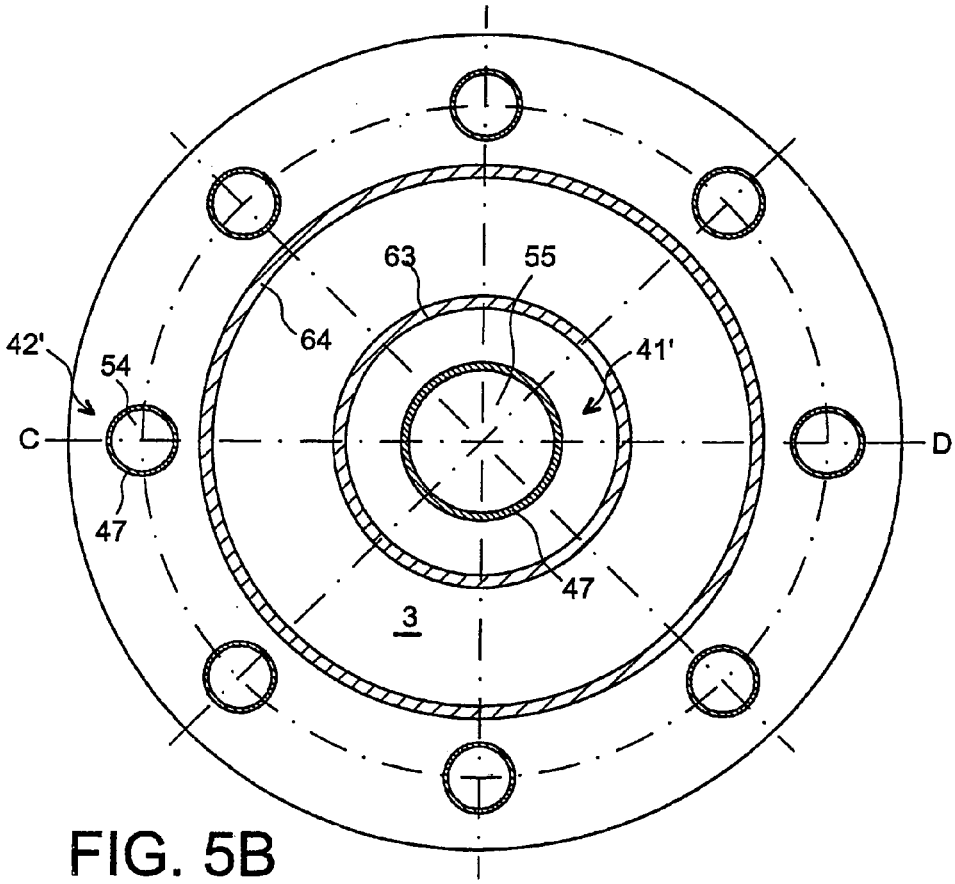
FIG. 5B shows a cross-section of the third example magnetic circuit of a plasma thruster according to the invention, the section having been made along the line AB of FIG. 5A.

In the example shown in FIGS. 4 A and B, all of the peripheral arms 42 consist entirely of a soft magnetic material. A field coil 52 is arranged around each of the arms 42. On the other hand, the central arm 41' comprises a downstream portion 44 made of a soft magnetic material, a rare earth permanent magnet 55, and an upstream portion 46 made of a soft magnetic material, this upstream portion 46 holding the magnetic pole 49.

In this configuration, no central field coil is arranged around the central arm 41.

In this second embodiment, the central arm 41' comprises a permanent magnet 55; the peripheral arms 42 are made of a magnetic material only, and a field coil 52 is engaged around each of said peripheral arms 42.

Each of the arms 41' or 42' comprising a permanent magnet 55, 54, respectively, comprise a peripheral jacket 47, exterior to said arm, made of a non-magnetic material. This jacket 47 makes it possible, e.g., by means of squeezing, to hold mechanically assembled together the downstream 43, 44 and upstream 45, 46 portions, as well as the magnet 54, 55, together forming an arm 42', 41', respectively. The magnet 54, 55 is held in contact with the downstream 43, 44 and upstream 45, 46 portions respectively.

In the example shown in FIGS. 5 A and B, there are 8 peripheral arms 42' which, as in the embodiment described in connection with FIGS. 3 A and B, comprise permanent magnets 54. In the same way, the central arm 41' comprises a downstream portion 44 made of a soft magnetic material, a rare earth permanent magnet 55, and an upstream portion 46 made of a soft magnetic material, this upstream portion 46 hold the magnetic pole 49. A jacket 47 ensures the mechanical cohesion of the parts together forming an arm 42' or 41' and ensures that the magnetic core portions 43, 45 and the permanent magnet 54 are held in coaxial position.

In this configuration, no central field coil is arranged around the central arm 41' or around the peripheral arms 42' comprising a permanent magnet 54.

In this third configuration, the central arm 41' comprises a permanent magnet 55, and all of the peripheral arms 42' comprise a permanent magnet 54.

In all of the configurations of the invention, the power of the magnets is adjusted such that the magnet field has an optimal value within the thruster's anticipated operating temperature range.

In the case of the configurations comprising coils 51 and/or 52, the power of the magnets is also adjusted such that the number of coils is minimal.

The invention claimed is:

1. A hall-effect plasma thruster having a longitudinal axis substantially parallel to a thrust direction defining an upstream portion and a downstream portion, and comprising:

a primary ionization and acceleration channel made of a refractory material surrounded by two circular cylindrical poles, the acceleration channel being open at its upstream end;

an annular gas-dispensing anode receiving gas from gas-distribution lines and equipped with passages for admitting the gas into the acceleration channel, the annular anode being placed inside of the acceleration channel in an downstream portion of the acceleration channel;

at least one hollow cathode arranged outside the acceleration channel, and adjacent thereto;

a magnetic circuit comprising upstream polar ends for creating a radial magnetic field in an upstream portion of the channel between the polar ends, the magnetic circuit including a downstream plate, from which protrude, upstream and parallel to the longitudinal axis, a central arm situated at a center of the acceleration channel, two circular cylindrical poles on both sides of the acceleration channel, and peripheral arms situated on an exterior of the acceleration channel and adjacent thereto, wherein at least one of the peripheral arms of the magnetic circuit comprises a downstream portion made of a soft magnetic material, an upstream portion made of a soft magnetic material, and a permanent magnet centrally disposed between the downstream portion and the upstream portion.

2. The plasma thruster as claimed in claim 1, wherein no field coil is engaged around the peripheral arms of the magnetic circuit comprising the permanent magnet.

3. The plasma thruster as claimed in claim 1, wherein the peripheral arms are arranged in rotational symmetry around the longitudinal axis.

4. The plasma thruster as claimed in claim 1, wherein the peripheral arms each comprise a permanent magnet, wherein the central arm is made of a magnetic material only, and wherein a field coil is engaged around the central arm.

5. The plasma thruster as claimed in claim 1, wherein the central arm comprises a permanent magnet, a field coil is engaged around the central arm.

6. The plasma thruster as claimed in claim 1, wherein the central arm comprises a permanent magnet, and wherein all of the peripheral arms comprise a permanent magnet.

* * * * *